US008491208B2

(12) United States Patent
Eoka

(10) Patent No.: US 8,491,208 B2
(45) Date of Patent: Jul. 23, 2013

(54) PRINTER

(75) Inventor: Kenji Eoka, Suntoh-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 336 days.

(21) Appl. No.: 12/860,393

(22) Filed: Aug. 20, 2010

(65) Prior Publication Data

US 2011/0058880 A1 Mar. 10, 2011

(30) Foreign Application Priority Data

Sep. 10, 2009 (JP) ..... 2009-208796

(51) Int. Cl.
*B41J 2/315* (2006.01)

(52) U.S. Cl.
USPC ..... 400/120.17; 400/56; 400/120.01; 400/120.16; 347/198

(58) Field of Classification Search
USPC ..... 400/120.17, 120.01, 120.09, 120.16, 400/186, 189, 188, 53, 124.05, 56; 271/265.04, 271/291, 186; 347/198
See application file for complete search history.

(56) References Cited

U.S. PATENT DOCUMENTS 4,775,869 A 10/1988 Minowa
5,452,959 A * 9/1995 Oka ..... 400/149
7,355,613 B2 * 4/2008 Wiens ..... 347/171
8,038,286 B2 * 10/2011 Kadomatsu et al. ..... 347/103
2006/0119880 A1 6/2006 Dandekar et al.
2008/0003038 A1 * 1/2008 Nihashi et al. ..... 400/188

FOREIGN PATENT DOCUMENTS

JP 63-92469 4/1988
JP 04-45060 10/1992
JP 08-295043 11/1996
JP 2006-178943 7/2006

* cited by examiner

*Primary Examiner* — Matthew G Marini
(74) *Attorney, Agent, or Firm* — Turocy & Watson, LLP

(57) ABSTRACT

A printer includes a conveying path for conveying a printing medium therealong. The printer also includes a thickness detecting unit configured to detect change in thickness of the printing medium along the conveying direction, which is conveyed along the conveying path. The printer also includes a first print unit configured to print information on one surface of the printing medium whose thickness change is detected by the thickness detecting unit, and a second print unit configured to print information on another surface of the printing medium. The printer also includes a pressure mechanism configured to press the print head against the platen of each of the first and second print units, and a control unit configured to reduce pressure applied to the print head by the pressure mechanism if the thickness of the printing medium detected by the thickness detecting unit is greater than a predetermined threshold value.

18 Claims, 4 Drawing Sheets

PRINTER

CROSS-REFERENCE TO RELATED APPLICATIONS

This application is based upon and claims the benefit of priority from Japanese Patent Application No. 2009-208796, filed on Sep. 10, 2009, the entire contents of which is incorporated herein by reference.

FIELD

Embodiment(s) described herein relate(s) generally to a printer that includes a first print unit and a second print unit so that information is respectively printed on both surfaces of a printing medium by the first and second print units.

BACKGROUND

Some printers are designed such that the first and second print units are arranged and disposed along a medium conveying path of the printer. Each of the first and second print units may include a thermal head and a platen that are opposed to each other so as to be spaced apart from each other, and is configured to print information on a front surface and a rear surface of the medium respectively.

The thermal head may be elastically biased by means of an elastic biasing member such as a spring so that it is brought into pressure contact with the platen, and the medium passes between the thermal head and the platen.

However, conventionally, since the thermal head is brought into pressure contact with the platen by certain elastic biasing force, the thickness of the medium may not be constant along the conveying direction of the medium. For example, when an electronic tag for RFID is contained in label paper as a medium, a label paper portion bearing the electronic tag has increased thickness. Thus, when the label paper portion having the electronic tag contained therein passes between the thermal head and the platen, the tag could receive high impact, which may damage the electronic tag.

DETAILED DESCRIPTION

An embodiment provides a printer. The printer according to an embodiment includes a conveying path for conveying a printing medium therealong, and detecting means for detecting a change in a thickness of the printing medium along the conveying direction, which is conveyed along the conveying path. The printer also includes printing means comprising a first print unit configured to print information on one surface of the printing medium whose thickness change is detected by the detecting means, and a second print unit configured to print information on another surface of the printing medium, the first print unit and the second print unit comprising a print head and a platen that are disposed opposite to each other along the conveying path, and a pressure means configured to press the print head against the platen of each of the first and second print units. The printer also includes a control means configured to variably control the pressure applied to the print head by the pressure means based on information on the thickness of the printing medium detected by the detecting means.

Now, a printer according to an exemplary embodiment of the present invention will be hereinafter described in detail with reference to the accompanying drawings.

Figure 1:
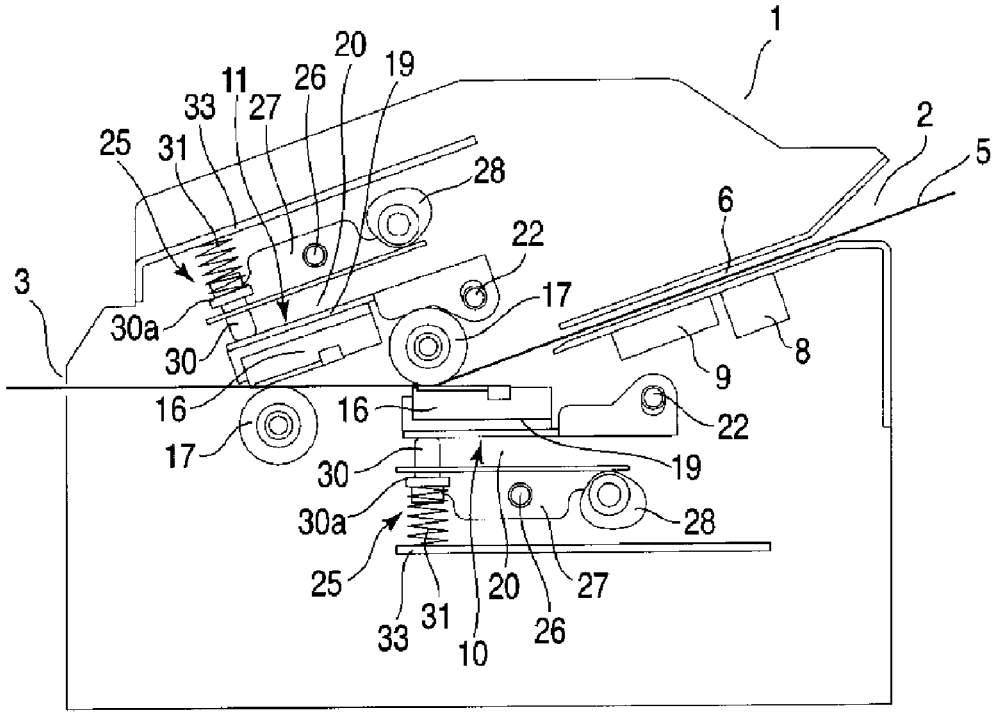
FIG. 1 illustrates a schematic cross-sectional view of an embodiment of a printer in a state where a print head is in high pressure contact with a platen.

FIG. 1 illustrates a schematic cross-sectional view of an embodiment of a printer. As shown in FIG. 1, the printer includes a main body 1 which is provided with a paper feed inlet 2 formed at one side thereof so as to allow a paper to be fed into the main body therethrough and a paper discharge outlet 3 formed at another side thereof so as to allow the paper to be discharged to the outside therethrough.

The main body 1 has a conveying path 6 formed therein so that label paper 5 as a printing medium fed to the main body through the paper feed inlet 2 is conveyed along the conveying path 6 toward the paper discharge outlet 3. A thickness detecting unit 8 serving as detecting means and a reader and writer device 9, and first and second print units 10 and 11 serving as printing means are arranged and disposed along the conveying direction of label paper 5 in the conveying path 6.

Figure 2:
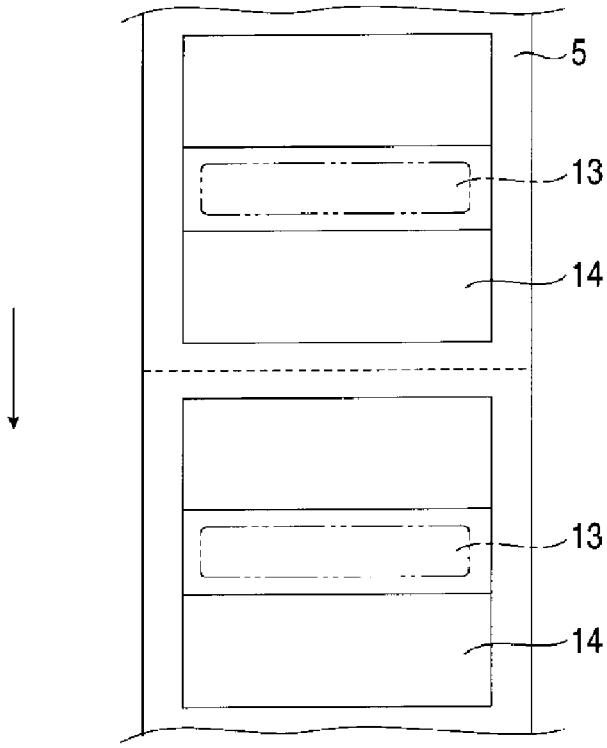
FIG. 2 illustrates a top plan view of a printing medium used in the printer of FIG. 1.
Figure 3:
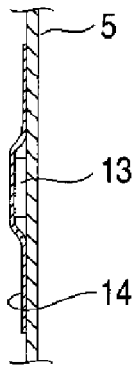
FIG. 3 illustrates a partial side cross-sectional view of the printing medium of FIG. 2.

As shown in FIGS. 2 and 3, the label paper 5 has at least one wireless tag 13 arranged on one surface thereof along the conveying direction (indicated by an arrow) so that the wireless tags 13 are spaced apart from each other at predetermined intervals. The wireless tags 13 are sealed by a sealing material. A variety of information may be recorded in the wireless tags 13.

The thickness detecting unit 8 detects a change in the thickness of the label paper 5 according to the conveying direction of the label paper 5.

The reader and writer device 9 reads or writes information on the wireless tags 13.

Each of the first and second print units 10 and 11 may include a thermal head (print head) 16 and a platen roller 17 that are disposed opposite to each other along the conveying path 6. The first print unit 10 includes a platen roller 17 disposed above the conveying path 6 and a thermal head 16 disposed below the conveying path 6. The second print unit 10 includes a thermal head (print head) 16 disposed above the conveying path 6 and a platen roller 17 disposed below the conveying path 6. The first print unit 10 is configured to print information on a print area of the rear surface (one surface) of the label paper 5, and the second print unit 11 is configured to print information on a print area of the front surface (the other surface) of the label paper 5.

The thermal head 16 of each of the first and second print units 10 and 11 and a head support plate 19, to which the thermal head 16 is attached, constitute a head unit 20. The head support plate 19 is rotatably supported on a support shaft 22 which is secured to a frame of the main body of the printer.

In addition, the head unit 20 is configured to apply pressure by a pressure mechanism 25 as pressure means to cause the thermal head 16 to be brought into pressure contact with the platen roller 17.

The pressure mechanism 25 includes a cam arm 27 that is rotatably supported at a roughly central portion by a shaft 26. Each of the three cam arms 27 are arranged and disposed at both ends and a central portion of the head support plate 19 in such a fashion as to confront each other in the width direction of the head support plate 19, i.e., in the direction orthogonal to the conveying direction of the label paper.

The cam arm 27 abuts against a cam 28 at one end, and is attached with a press pin 30 at the other end. The press pin 30 is elastically biased toward the head support plate 19 by means of a head spring 31 as an elastic biasing member having a coil shape.

One end of the head spring 31 is fixed to a fixed frame 33, and another end is fitted with a head portion of the press pin 30. The head portion of the press pin 30 has a flange 30*a* formed on the outer circumference thereof The other end of the head spring 31 abuts against the flange 30*a* of the head pin 30.

Figure 4:
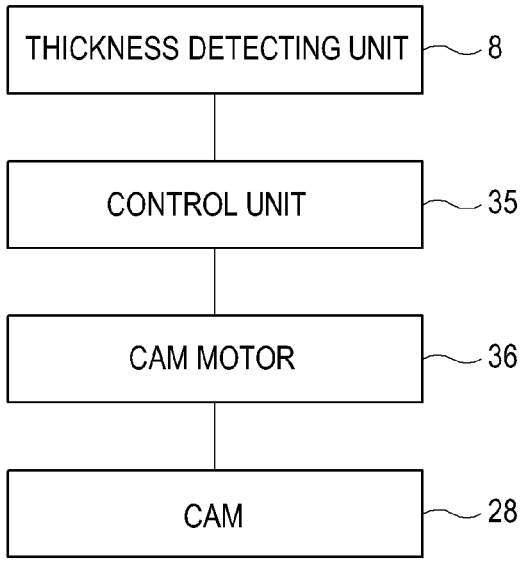
FIG. 4 illustrates a block diagram of a drive control system for controlling the print head to be moved in the direction in which the thermal head approaches and is separated with respect to the platen of FIG. 1.

FIG. 4 is a block diagram of a control system for variably controlling a pressure contact force of the thermal head 16 against the platen roller 17.

The thickness detecting unit 8 is connected to a control unit 35 through a transmitting circuit, and a cam motor 36 is connected to the control unit 35 through a control circuit. The control unit 35 controls the cam motor 36 to be driven to turn the cam 28 based on a change in the thickness of the label paper 5 detected by the thickness detecting unit 8.

That is, if the thickness detecting unit 8 detects a thin portion (print area) of the label paper 5, the control unit 35 drives the cam motor 36 when the detected portion (print area) is fed between the thermal head 16 and the platen roller 17 so as to set the cam 28 to an initial position as shown in FIG. 1.

At this time, the head unit 20 is pressed by means of three press pins 30 elastically biased by three head springs 31 to cause the thermal head 16 to be brought into pressure contact with the platen roller 17 with a high pressure contact force.

Figure 5:
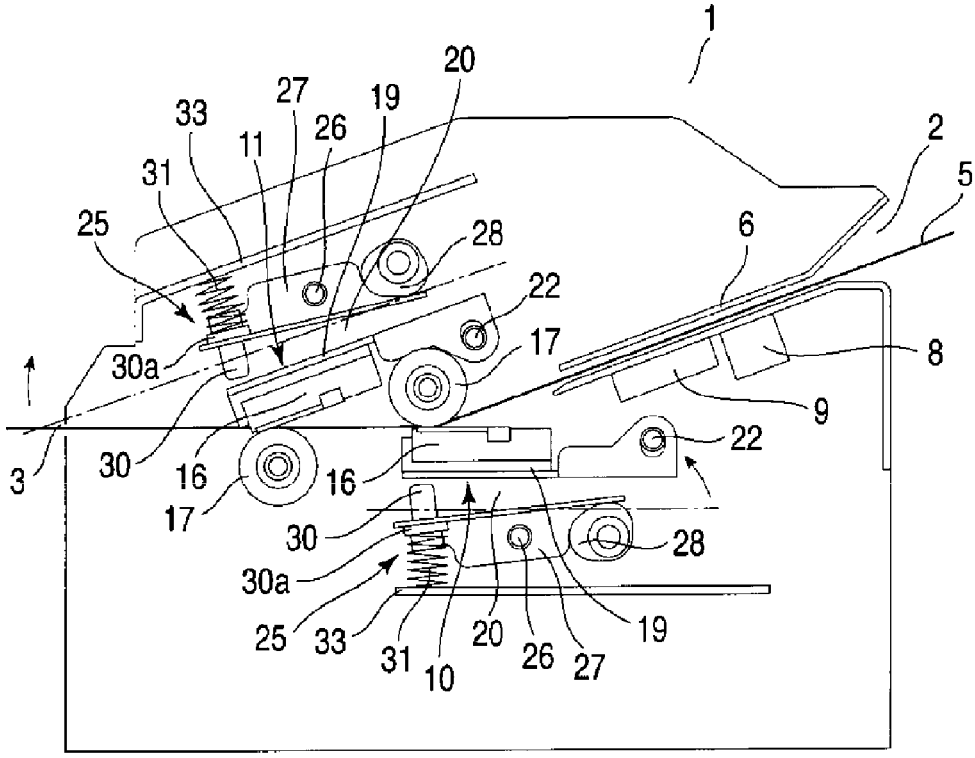
FIG. 5 illustrates a schematic cross-sectional view of an embodiment of a printer in a state where the print head is in low pressure contact with the platen.

Also, if the thickness detecting unit 8 detects a thick portion of the label paper 5, i.e., a wireless tag-embedded portion of the label paper 5, the control unit 35 drives the cam motor 36 when the detected portion (wireless tag-embedded portion) is fed between the thermal head 16 and the platen roller 17 so as to turn the cam 28 to cause one stroke, as shown in FIG. 5. The thickness detecting unit 8 may be configured to classify a portion of the label paper 5 as thick if the detected thickness is greater than a predetermined threshold value.

At this time, two head springs 31 positioned at both sides are compressed by turning the cam arm 27 so that two press pins 30 positioned at both sides are separated from the head unit 20. Consequently, the head unit 20 is pressed by one press pin 30 elastically biased by one head spring 31 positioned at a central portion to cause the thermal head 16 to be brought into pressure contact with the platen roller 17 with a low pressure contact force (compared to the high pressure contact force described above). The low pressure contact force may be of a pressure that is sufficient to reduce damage to a wireless tag if it is embedded in the label paper 5.

Figure 6:
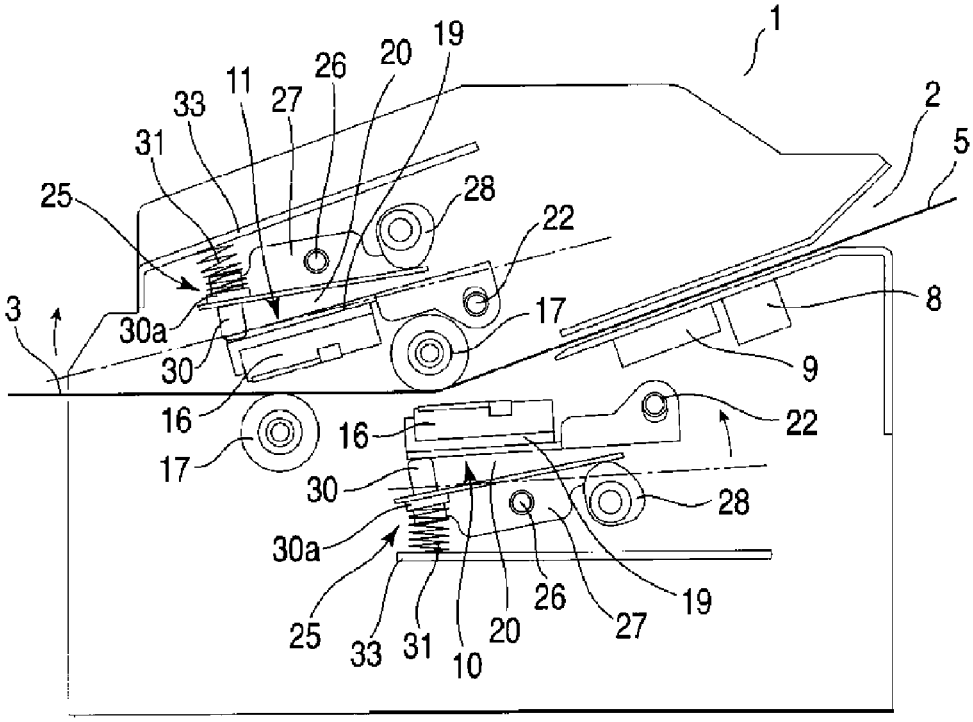
FIG. 6 illustrates a schematic cross-sectional view of an embodiment of a printer in a state where the print head is separated from the platen.

When the control unit 35 receives a command for, such as, rewinding of the label paper 5, the control unit 35 turns the cam 28, as shown in FIG. 6, to cause two strokes from the state shown in FIG. 5. Consequently, all of the three head springs 31 positioned at three places are compressed and simultaneously the head support plate 19 is lifted by the cam arm 27 to cause the head unit 20 to be separated from the platen roller 17.

Next, the print operation of the printer, as constructed above, will be described hereinafter.

When the label paper 5 is conveyed into the printer along the conveying path 6, information on the electronic tag 13 embedded in the label paper is read by the reader and writer device 9 and the thickness of the label paper in the conveying direction is detected by the thickness detecting unit 8. Based on the information read by the read and writer device 9, information is printed on a print area of one surface of the label paper 5 by the first print unit 10, and information is printed on a print area of another surface of the label paper 5 by the second print unit 11.

In the print operation, a pressure contact force of the thermal head 16 against the platen roller 17 is variably controlled when a portion detected by the thickness detecting unit 8 is fed to the first print unit 10 or the second print unit 11.

In other words, if the portion of the label paper 5 fed to the first print unit 10 or the second print unit 11 is a print area (i.e., thin portion), the head unit 20 is pressed by means of three press pins 30 elastically biased by all the three head springs 31 as shown in FIG. 1. As a result, the thermal head 16 is brought into pressure contact with platen roller 17 with a high pressure contact force so that information is printed on the print area of the label paper 5.

Further, if the portion of the label paper 5 fed to the first print unit 10 or the second print unit 11 is a portion embedded with the wireless tag 13 (i.e., thick portion), the cam 28 is turned from its initial position to cause one stroke. Consequently, two head springs 31 positioned at both sides are compressed by two cam arms 27 so that two press pins 30 positioned at both sides are separated from the head unit 20. Thus, head unit 20 is pressed only by means of one press pin 30 elastically biased by head spring 31 positioned at the central portion to cause the thermal head 16 to be brought into pressure contact with platen roller 17 with a low pressure contact force.

Furthermore, the present invention is not limited to the above-mentioned embodiment, but may be embodied by modifying the constituent elements set forth herein without departing the scope of the invention in the step of carrying out the invention.

While certain embodiments have been described, these embodiments have been presented by way of example only, and are not intended to limit the scope of the inventions. Indeed, the novel paper discharge device and the image forming apparatus including the paper discharge device described herein may be embodied in a variety of other forms; furthermore, various omissions, substitutions and changes in the form of the paper discharge device and the image forming apparatus including the paper discharge device described herein may be made without departing from the spirit of the inventions. The accompanying claims and their equivalents are intended to cover such forms or modifications as would fall within the scope and spirit of the inventions.

What is claimed is:

1. A printer comprising:

a conveying path for conveying a printing medium;

a detecting unit for detecting a change in a thickness of the printing medium which is conveyed along the conveying path;

a printing unit comprising a first print unit configured to print information on one surface of the printing medium whose thickness change is detected by the detecting unit, and a second print unit configured to print information on another surface of the printing medium, the first print unit and the second print unit respectively comprising a print head and a platen that are disposed opposite to each other along the conveying path;

a first pressure unit configured to press the print head against the platen of the first print unit;

a second pressure unit configured to press the print head against the platen of the second print unit; and a control unit configured to control the pressure applied to the print head by each of the first and the second pressure units based on information on the thickness of the printing medium detected by the detecting unit, wherein each of the first and the second pressure units comprises a cam, a plurality of cam arms configured to be turned by the cam, a plurality of press pins each attached to a turning end side of a corresponding one of the cam arms, a plurality of elastic biasing members each configured to elastically bias a corresponding one of the press pins so as to cause the print head to be placed into pressure contact with the platen, and wherein the print head is pressed by at least one of the plurality of press pins through the turning of the cam.

2. The printer of claim 1, wherein the control unit controls the print head to be placed into pressure contact with the platen with a high pressure contact force if the thickness of the printing medium detected by the detecting unit is thin, and the control unit controls the print head to be placed into pressure contact with the platen with a low pressure contact force if the thickness of the printing medium detected by the detecting unit is thick.

3. The printer of claim 2, wherein the control unit controls the print head to be separated from the platen through the turning of the cam if the control unit receives command including rewinding of the printing medium.

4. The printer of claim 1, wherein the print head is pressed by one of the plurality of press pins through the turning of the cam if the thickness of the printing medium detected by the detecting unit is thick.

5. The printer of claim 1, wherein the print head is pressed by all of the plurality of press pins through the turning of the cam if the thickness of the printing medium detected by the detecting unit is thin.

6. The printer of claim 1, wherein the printing medium is a label paper comprising at least one wireless tag arranged and disposed at predetermined intervals along the conveying direction of the printing medium, and a sealing material for sealing the wireless tags.

7. The printer of claim 1, wherein each of the first and second print units comprises a head unit comprising a rotatably-supported head support plate and the print head attached to the head support plate.

8. A printer comprising:

a conveying path for conveying a printing medium, the conveying path defining a paper feed inlet at one end and a paper discharge outlet at another end thereof;

a thickness detecting unit disposed closer to the paper feed inlet than the paper discharge outlet, the thickness detecting detects change in thickness of the printing medium which is conveyed along the conveying path;

a first print unit configured to print information on one surface of the printing medium whose thickness change is detected by the thickness detecting unit, and a second print unit configured to print information on another surface of the printing medium, each of the first and second print units respectively including a print head and a platen that are disposed opposite to each other along the conveying path;

a first pressure mechanism configured to press the print head against the platen of the first print unit;

a second pressure mechanism configured to press the print head against the platen of the second print unit; and a control unit configured to reduce pressure applied to the print head by each of the first and the second pressure mechanisms if the thickness of the printing medium detected by the thickness detecting unit is greater than a predetermined threshold value, wherein each of the first and the second pressure mechanisms includes a cam, a plurality of cam arms configured to turned by the cam, a plurality of press pins each attached to a turning end side of a corresponding one of the cam arms, a plurality of elastic biasing members each configured to elastically bias a corresponding one of the press pins so as to cause the print head to be placed into pressure contact with the platen, and wherein the print head is pressed by at least one of the plurality of press pins through the turning of the cam.

9. The printer of claim 8, wherein the print head is pressed by one of the plurality of press pins through the turning of the cam if the thickness of the printing medium detected by the thickness detecting unit is thick.

10. The printer of claim 8, wherein the print head is pressed by all of the plurality of press pins through the turning of the cam if the thickness of the printing medium detected by the thickness detecting unit is thin.

11. The printer of claim 8, wherein the control unit controls the print head to be placed into pressure contact with the platen with a high pressure contact force if the thickness of the printing medium detected by the thickness detecting unit is less the predetermined threshold value, and the control unit controls the print head to be placed into pressure contact with the platen with a low pressure contact force if the thickness of the printing medium detected by the detecting unit is greater than the predetermined threshold value.

12. The printer of claim 11, wherein the predetermined threshold value substantially corresponds to the thickness of a wireless tag arranged on a surface of the printing medium.

13. The printer of claim 8, wherein the first and second print units are opposed to each other.

14. The printer of claim 13, wherein the first print unit is disposed closer to the paper feed inlet than the second print unit.

15. The printer of claim 14, wherein the second print unit is closer to the paper discharge outlet than the first print unit.

16. The printer of claim 15, wherein the first print unit is configured to print on a rear surface of the printing medium, and the second print unit is configured to print on the front surface of the printing medium.

17. The printer of claim 8, wherein the print head of the first print unit is disposed below the conveying path and the platen of the first print unit is disposed above the conveying path.

18. The printer of claim 17, wherein the print head of the second print unit is disposed above the conveying path and the platen of the second print unit is disposed below the conveying path.

* * * * *